US011445827B1

(12) United States Patent
Lee

(10) Patent No.: US 11,445,827 B1
(45) Date of Patent: Sep. 20, 2022

(54) CHAIR WITH FOREHEAD REST

(71) Applicant: Seungwoo Lee, Seoul (KR)

(72) Inventor: Seungwoo Lee, Seoul (KR)

( * ) Notice: Subject to any disclaimer, the term of this patent is extended or adjusted under 35 U.S.C. 154(b) by 0 days.

(21) Appl. No.: 17/723,851

(22) Filed: Apr. 19, 2022

(30) Foreign Application Priority Data

Aug. 6, 2021 (KR) ..... 10-2021-0103948

(51) Int. Cl.

| | |
|---|---|
| ***A47C 7/38*** | (2006.01) |
| *A47C 1/10* | (2006.01) |
| *A61G 15/00* | (2006.01) |
| *A47C 16/00* | (2006.01) |
| *A47C 1/036* | (2006.01) |
| *A47C 20/00* | (2006.01) |
| *A61G 5/12* | (2006.01) |
| *A61G 1/04* | (2006.01) |

(52) U.S. Cl.
CPC ..... *A47C 7/38* (2013.01); *A47C 1/036* (2013.01); *A47C 1/10* (2013.01); *A47C 16/00* (2013.01); *A47C 20/00* (2013.01); *A61G 1/04* (2013.01); *A61G 5/121* (2016.11); *A61G 15/00* (2013.01)

(58) Field of Classification Search
CPC ..... A47C 7/38; A47C 1/036; A47C 1/101; A47C 20/00; A47C 16/00; A61G 15/00; A61G 1/04; A61G 1/042; A61G 5/121
See application file for complete search history.

(56) References Cited

U.S. PATENT DOCUMENTS 10,555,861 B2 * 2/2020 Zwierstra ..... A61B 90/14

FOREIGN PATENT DOCUMENTS

| | | | |
|---|---|---|---|
| CN | 101313810 | A | 12/2008 |
| CN | 210611575 | U | 5/2020 |
| KR | 20-0308330 | Y1 | 3/2003 |

OTHER PUBLICATIONS

Korean Decision to Grant Patent for KR 10-2021-0103948 dated Feb. 8, 2022.

* cited by examiner

*Primary Examiner* — Syed A Islam
(74) *Attorney, Agent, or Firm* — Sughrue Mion, PLLC

(57) ABSTRACT

Provided is a chair with a forehead rest, including a seating part which includes a seat board and a support leg supporting the seat board and on which a user is seated, a main support arm, an elastic support arm which is provided on an upper end of the main support arm and includes a first elastic support arm part that bends forward while protruding upward and a second elastic support arm part protruding downward from a leading end of the first elastic support arm part to be bent rearward toward a lower end of the second elastic support arm part, and a forehead rest which is provided on a leading end of the second elastic support arm part of the elastic support arm and by which the forehead of the user is supported.

4 Claims, 6 Drawing Sheets

[FIG. 1]
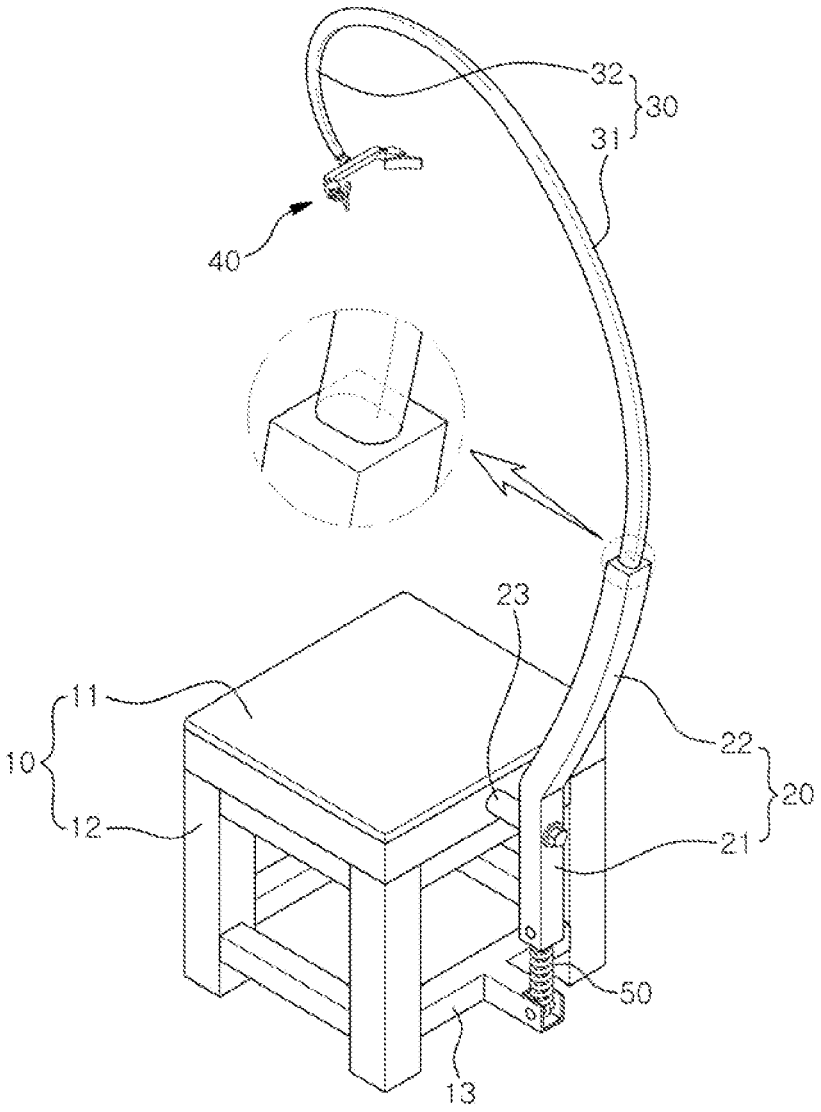

[FIG. 2]
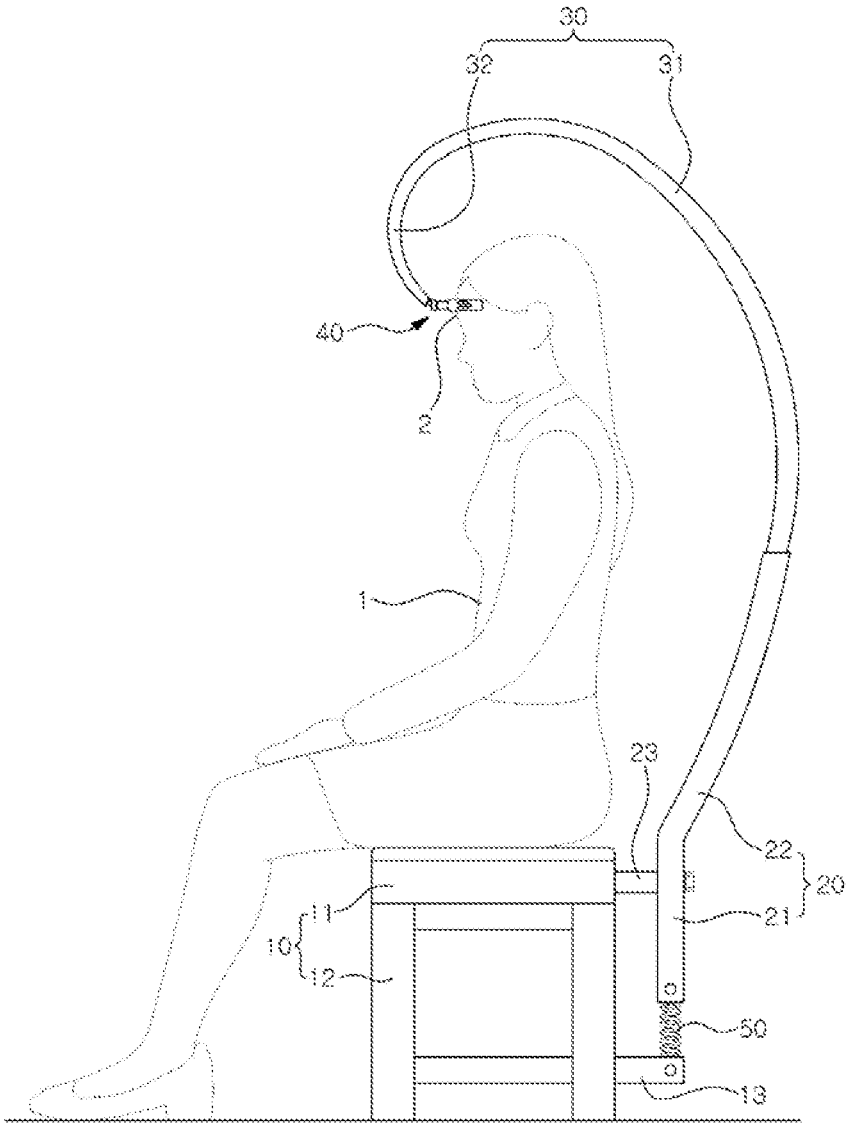

[FIG. 3]
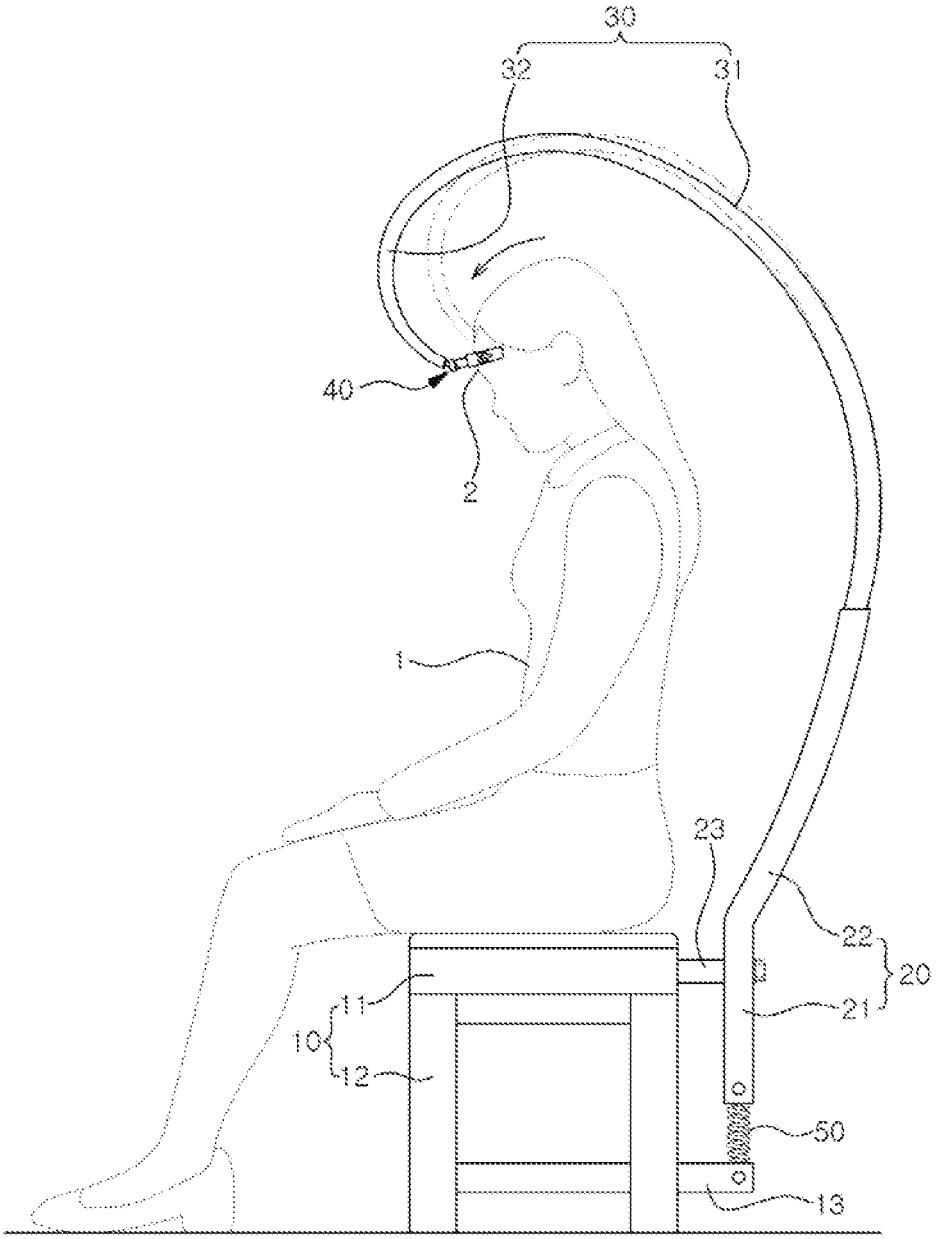

[FIG. 4]
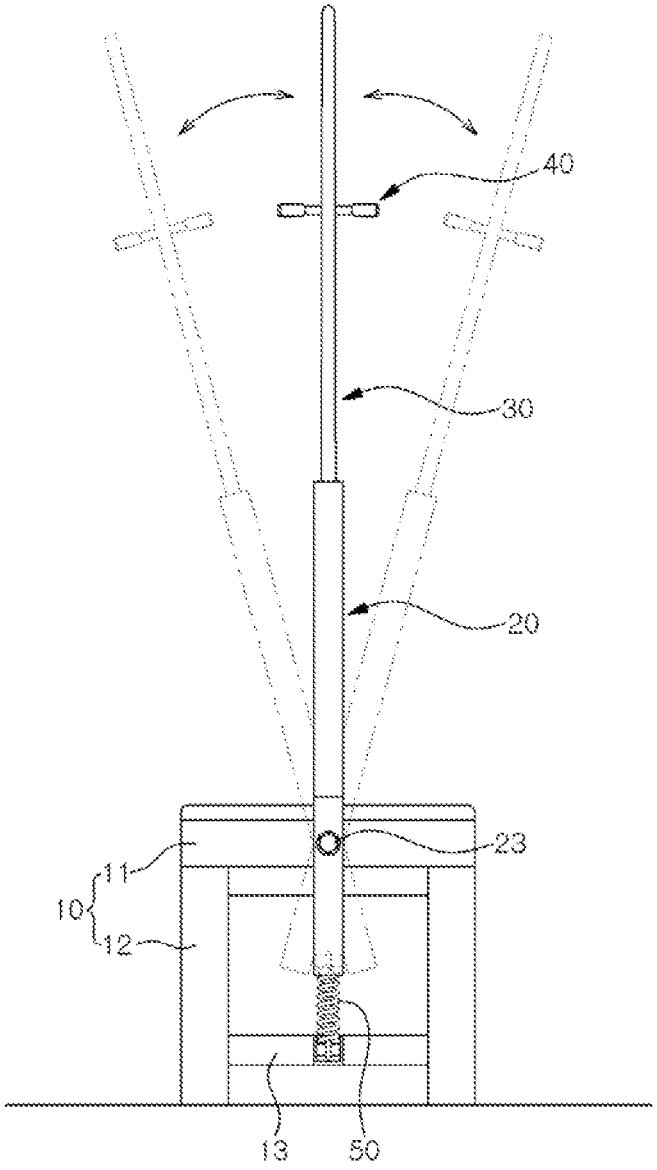

[FIG. 5]
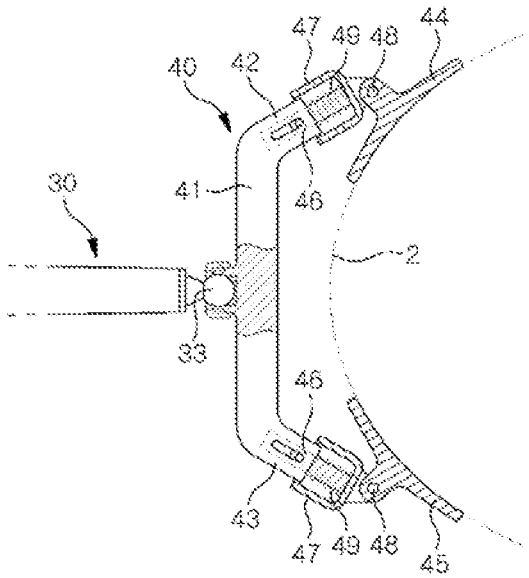
(a)
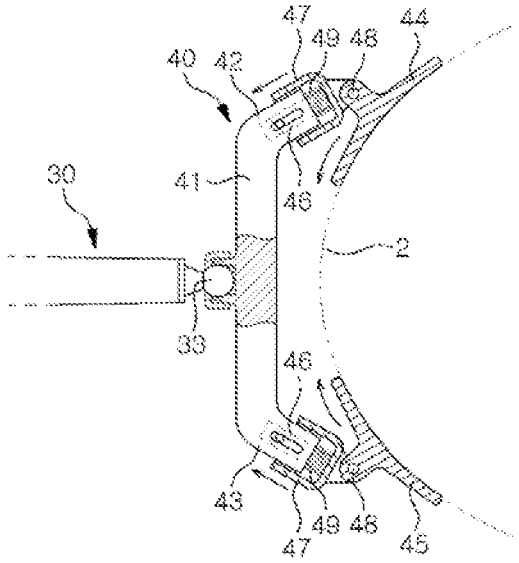
(b)

[FIG. 6]
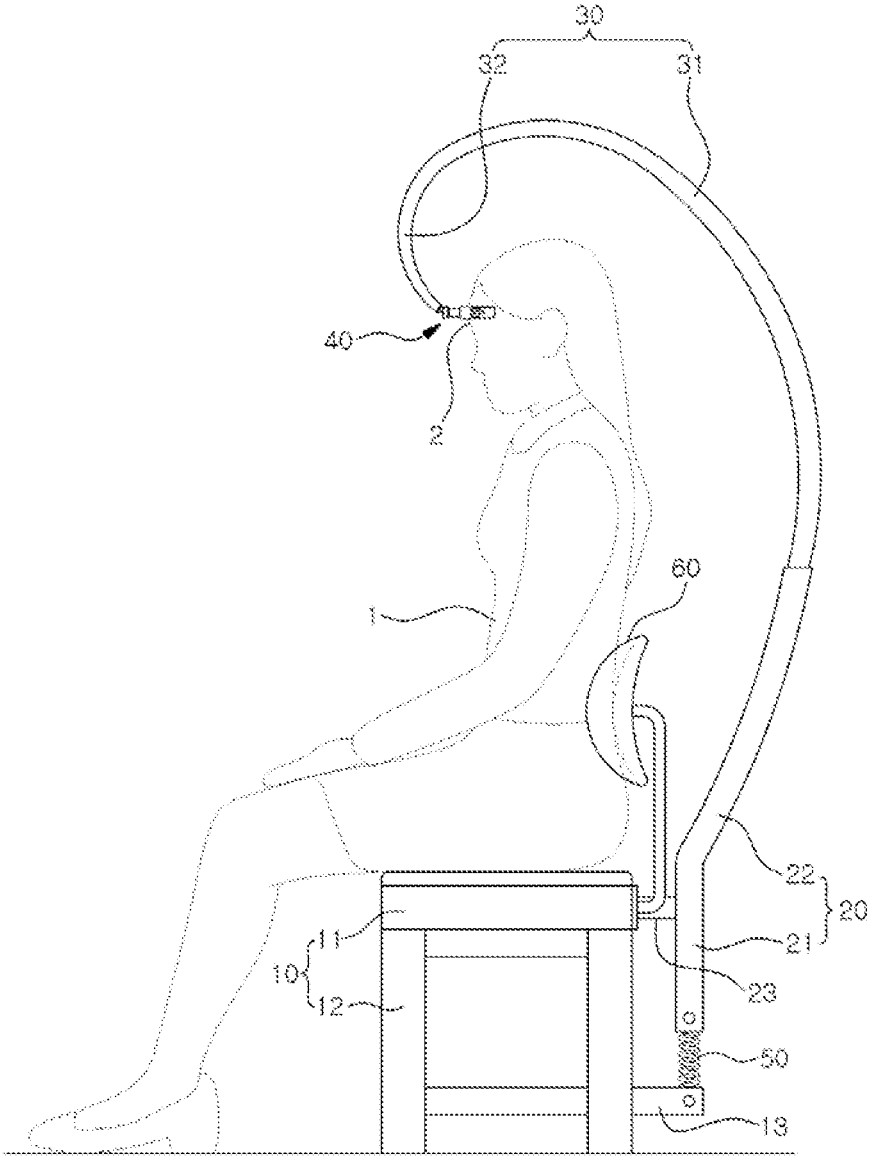

CHAIR WITH FOREHEAD REST

CROSS-REFERENCE TO RELATED APPLICATION

This application claims priority to and the benefit of Korean Patent Application No. 2021-0103948, filed on Aug. 6, 2021, the disclosure of which is incorporated herein by reference in its entirety.

BACKGROUND

1. Field of the Invention

The present invention relates to a chair with a forehead rest, and more specifically, to a chair with a forehead rest capable of preventing a disease such as cervical herniated nucleus due to a forward head posture and the like by effectively supporting a user's forehead according to the user's posture.

2. Discussion of Related Art

Generally, office workers who use computers for a long time, students who read books for a long time, dentists who treat patients lying down, and the like are faced with situations in which they should bend their necks for a long time. When their necks are bent, muscles in the back of the neck should be contracted in order to support the weight of the head, and when the muscles in the back of the neck are contracted, a pressure is applied to the neck discs. In addition, when an inappropriate posture becomes fixed under these unfavorable conditions, "text neck" easily occurs.

"Text neck" occurs due to use of an information processing device such as a computer or a portable phone, or when a dentist abnormally stretches her or his neck forward in order to treat a patient who lies down as described above, and thus an excessive load is applied to the neck. The forward head posture can cause myofascial pain, headaches, sleep disturbances, and breathing problems as well as cervical herniated nucleus.

In order to solve such a problem, a forehead support device is proposed through Korean Utility Model Publication No. 20-0308330. The conventional forehead support device includes a support pad which is formed by connecting leading ends of a pair of links protruding upward from a back of a chair to support a forehead and supports the forehead in a state in which a user is seated in the chair, thereby sharing the role of the muscles in the back of the neck that support the head.

However, since a position of the conventional forehead support device is fixed by properly rotating links and fastening the links using a fastening member, there is a problem that a support pad is set to one determined position and does not move forward, rearward, leftward, or rightward. Accordingly, problems with this include that, since a user should be seated in a chair with only one posture in a state in which his or her forehead is in contact with the support pad, it is inconvenient for the user because the movement of the user is excessively restricted, and when the user wants to pick something up from a table or talk with people around him or her, since the user should separate his or her forehead from the support pad, it is inconvenient for the user. In addition, the process of separating the forehead from the support pad and pressing it against the support pad again when the user changes the position of his or her head is troublesome.

RELATED ART

Patent Document (Patent Document 1) Korean Utility Model Publication No. 20-0308330

SUMMARY OF THE INVENTION

The present invention is directed to providing a chair with a forehead rest capable of effectively preventing a neck disc disease due to contraction and pressurization of muscles in the back of the neck of a user by effectively supporting the forehead of the user according to movement of the user, allowing the user to further freely move to watch a computer, a portable phone, a book, and the like with a more healthy posture, and allowing a dentist or the like to treat a patient with a more healthy posture.

According to an aspect of the present invention, there is provided a chair with a forehead rest, the chair including a seating part (10) which includes a seat board (11) and a support leg (12) supporting the seat board (11) and on which the user (1) is seated, a main support arm (20) which extends vertically and is rotatably coupled to one side of the seating part (10) by a hinge shaft (23) formed horizontally, an elastic support arm (30) which is provided on an upper end of the main support arm (20) and includes a first elastic support arm part (31) that bends forward while protruding upward and a second elastic support arm part (32) protruding downward from a leading end of the first elastic support arm part (31) to be bent rearward toward a lower end of the second elastic support arm part (32), and a forehead rest (40) which is provided on a leading end of the second elastic support arm part (32) of the elastic support arm (30) and by which a forehead (2) of a user (1) is supported, wherein the user (1) seated on the seating part (10) is allowed to move a head forward, rearward, leftward, and rightward in a state in which the forehead (2) is pressed against the forehead rest (40).

The chair with the forehead rest may further include an elastic member (50) having both end portions fixed to a lower end of the main support arm (20) and a lower end portion of the support leg (12) of the seating part (10), wherein the main support arm (20), which rotates about the hinge shaft (23), may be returned to an original state by the elastic member (50).

The forehead rest (40) may include a rest body (41) of which both end portions protrude forward and a central portion of a rear surface is rotatably coupled to a leading end of an elastic support arm (30) by a spherical hinge (33), a pair of rest heads (44, 45) of which central portions of rear surfaces are rotatably coupled to both end portions of the rest body (41) and in which curved surfaces are formed on front surfaces of the pair of rest heads (44, 45) to be pressed against the forehead (2) of the user (1), and buffer springs (49) which are provided at coupling portions of the rest heads (44, 45) and the rest body (41) and buffer the rest heads (44, 45).

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which:

FIG. 1 is a perspective view illustrating one embodiment of a chair with a forehead rest according to the present invention;

FIG. 2 is a side view illustrating a state of the embodiment in which a user is seated;

FIGS. 3 and 4 are views illustrating an operation state of the embodiment;

FIG. 5 is a set of views showing operation of a forehead rest of the embodiment; and FIG. 6 is a side view illustrating another embodiment of a chair with a forehead rest according to the present invention.

DETAILED DESCRIPTION OF EXEMPLARY EMBODIMENTS

The objectives, features, and advantages of the present invention will be clearer through detailed descriptions below. Hereinafter, exemplary embodiments of the present invention will be described with reference to the accompanying drawings.

FIGS. 1 to 5 are views illustrating a chair with a forehead rest according to one embodiment of the present invention. As illustrated in the drawings, the chair with the rest according to one embodiment of the present invention includes a seating part 10, a main support arm 20, an elastic support arm 30, and a forehead rest 40. The seating part 10 is a part on which a user 1 is seated and includes a seat board 11 and support legs 12 which support the seat board 11. As in FIG. 1, the plurality of support legs 12 are provided, and it is illustrated that a horizontal bar 13 horizontally connects lower sides of a pair of support legs 12 positioned at a rear surface thereof.

The main support arm 20 extends vertically and is rotatably coupled to one side of the seating part 10 by a hinge shaft 23 formed horizontally. As in FIG. 1, the main support arm 20 may be rotatably coupled to a central portion of a rear surface of the seat board 11 of the seating part 10 by the hinge shaft 23. In this case, the hinge shaft 23 may be positioned at an ergonomically advantageous position instead of the central portion of the rear surface of the seat board 11 of the seating part 10. The main support arm 20 may be formed of a hard material.

As in FIGS. 1 and 2, the main support arm 20 may include a first support arm part 21 which is formed in a straight shape and rotatably coupled to the hinge shaft 23 and a second support arm part 22 which is formed in a curved shape that is curved from an upper end of the straight first support arm part 21 in a rearward direction from the seating part 10. Since the curved second support arm part 22 is formed, the elastic support arm 30 can more stably and firmly support the forehead 2 of the user 1.

The elastic support arm 30 is provided on an upper end of the second support arm part 22 of the main support arm 20 and includes a first elastic support arm part 31 and a second elastic support arm part 32. The first elastic support arm part 31 is formed to bend forward while protruding upward from the main support arm 20, and the second elastic support arm part 32 protrudes downward from a leading end of the first elastic support arm part 31 and bends rearward. The first and second elastic support arm parts 31 and 32 may be integrally formed. The elastic support arm 30 is formed of an elastic material capable of easily bending according to the movement of the head of the user 1 and may be formed of carbon or a nickel-titanium alloy material.

The forehead rest 40 is a part by which the forehead 2 of the user 1 is supported and is provided at a leading end of the second elastic support arm part 32 of the elastic support arm 30.

As in FIG. 5, in the chair with the forehead rest according to one embodiment of the present invention, the forehead rest 40 may include a rest body 41, a pair of rest heads 44 and 45, and buffer springs 49.

In addition, both end portions of the rest body 41 protrude forward, and a central portion of a rear surface of the rest body 41 is rotatably coupled to a leading end of the elastic support arm 30 by a spherical hinge 33. As in FIG. 5, a pair of bent end portions 42 and 43 that bend forward are provided at both end portions of the rest body 41, and the bent end portions 42 and 43 may be formed in shapes protruding in opposite directions in a forward direction. In this case, the spherical hinge 33 may be provided on the rear surface of the rest body 41 or the leading end of the second elastic support arm part 32 of the elastic support arm 30. In FIG. 5, it is illustrated that the spherical hinge 33 is provided on the second elastic support arm part 32 of the elastic support arm 30.

In addition, the pair of rest heads 44 and 45 are parts which are spaced apart from each other and directly support the forehead 2 of the user 1, central portions of rear surfaces thereof are rotatably coupled to both end portions of the rest body 41, and front surfaces thereof may be formed in curved surfaces to be pressed against the forehead 2 of the user 1. The rest heads 44 and 45 are coupled to both end portions of the rest body 41 to be rotatable about centers of rotating shafts 48.

Meanwhile, flexible bars 46 are provided to be flexible at leading ends of the bent end portions 42 and 43 of the rest body 41, and guide caps 47 which guide flexibility of the flexible bars 46 are provided. In this case, the rest heads 44 and 45 are rotatably coupled to leading ends of the guide caps 47 by the rotating shafts 48.

Meanwhile, pads, which are not illustrated in the drawings, may be detachably provided on the curved surfaces of the rest heads 44 and 45. The pads may be formed of a material with superior ventilation and sweat absorption. Accordingly, in the summer or when used for a long time, the forehead 2 of the user 1 is prevented from sweating. In addition, since the pads can be attached and detached, the pads are easy to wash so that cleanliness can be maintained.

In addition, the buffer springs 49 are provided at coupling portions of the rest heads 44 and 45 and the rest body 41 to buffer impacts applied to the rest heads 44 and 45. As in FIG. 5, the buffer springs 49 are formed to surround the flexible bars 46 protruding from the bent end portions 42 and 43 of the rest body 41 and to be pressed by the guide cap 47. Accordingly, when the forehead 2 of the user 1 is pressed against the rest heads 44 and 45, predetermined pressures (impacts) are applied to the rest heads 44 and 45, and the impacts applied to the user as a reaction can be reduced by buffering the pressures (impacts).

In addition, as in FIG. 5B, when the forehead 2 of the user 1 moves forward to further press against the pair of rest heads 44 and 45 of the forehead rest 40, since the flexible bars 46 are contracted and the pair of rest heads 44 and 45 move closer, a problem in which a central portion of the forehead 2 is pulled toward both sides according to the forward movement of the forehead 2 of the user 1 due to the fixed rest heads 44 and 45 is solved. Accordingly, even when the user 1 freely moves the forehead 2, the forehead 2 is effectively prevented from being pulled or impacted.

When the user 1 is seated on the seating part 10 of the chair with the forehead rest according to one embodiment of the present invention and presses the forehead 2 against the pair of rest heads 44 and 45 of the forehead rest 40, the neck of the user 1 is prevented from excessively moving forward to prevent occurrence of a forward head posture and neck disc diseases due to the forward head posture.

In addition, as in FIGS. 2 and 3, even when the user 1 moves the head or body forward or rearward, a state in which the forehead 2 of the user 1 is pressed against the rest heads 44 and 45 of the forehead rest 40 is continuously maintained by an elastic force of the elastic support arm 30. In addition, as in FIGS. 2 and 4, even when the user 1 moves the head or body left or right, the state in which the forehead 2 of the user 1 is pressed against the rest heads 44 and 45 of the forehead rest 40 is continuously maintained by rotation of the main support arm 20. As described above, even when the user 1 freely moves the head or body forward, rearward, leftward, or rightward, since the state in which the forehead 2 is pressed against the forehead rest 40 is continuously maintained, even when the user 1 has a posture in which his or her neck is bent, muscles in the back of the neck are prevented from being excessively contracted and used so that a state in which the muscles in the back of the neck press discs can be avoided.

The chair with the forehead rest according to one embodiment of the present invention may further include an elastic member 50 of which both ends are fixed to a lower end of the main support arm 20 and a lower end portion of the support leg 12 of the seating part 10. As in FIG. 4, since the main support arm 20 which rotates about the hinge shaft 23 is easily returned to an original state by the elastic member 50, even when the forehead 2 of the user 1 is in contact with the forehead rest 40 and has a left or right inclined posture, the forehead 2 can be more stably supported.

FIG. 6 is a view illustrating a chair with a forehead rest according to another embodiment of the present invention. As illustrated in the drawing, a waist rest 60 protruding upward from a seat board 11 of a seating part 10 to support the waist of the user 1 may be further provided. Accordingly, the user 1 may have a more comfortable and appropriate posture. In some cases, a back may also be provided on a seat board 11.

In the chair with the forehead rest according to the embodiments of the present invention, a cross section of at least the first elastic support arm part 31 of the elastic support arm 30 may have an oval shape extending forward and rearward. As in FIGS. 1 and 4, when the user 1 moves the body left or right in the state in which the forehead 2 is pressed against the forehead rest 40, since a reaction due to an elastic restoring force applied to the forehead 2 of the user 1 is minimized while the first elastic support arm part 31 is bent, there is an advantage in that a phenomenon in which the skin of the forehead 2 is distorted laterally due to an external force laterally applied to the forehead 2 of the user 1 is minimized.

According to the embodiments, since the forehead rest 40 which supports the forehead 2 of the user 1 is provided at the leading end of the elastic support arm 30 protruding forward from the upper end of the main support arm 20 which is provided on the seating part 10 and rotates left or right, even when the user 1 freely moves his or her head and body forward, rearward, leftward, and rightward, the forehead 2 is continuously supported by the forehead rest 40, excessive contraction of muscles in the back of the neck or pressurization against the muscles is reduced because the forehead 2 is continuously supported even when the user 1 moves his or her body freely, and thus a forward head posture and a disease such as cervical herniated nucleus due to the forward head posture are effectively prevented.

In addition, the lower end of the main support arm 20 and the seating part 10 are connected by the elastic member 50 so that the main support arm 20 smoothly moves left or right and the main support arm 20 is prevented from completely falling down left or right from the seating part 10, and even when a posture of the head of the user 1 is inclined left or right, the head is stably supported, and the posture can be returned to an original posture with a small force.

Meanwhile, since the pair of rest heads 44 and 45 against which the forehead 2 of the user 1 is pressed are provided apart from the rest body 41 to be buffered by the buffer spring 49, even when a position of the forehead 2 of the user 1 is changed, the forehead rest 40 can effectively support the forehead 2, and a phenomenon in which the central portion of the forehead 2 is pulled by a force applied by the rest heads 44 and 45 to support both side portions of the forehead 2 can be reduced.

The above-described present invention is not limited to the above-described embodiments and the accompanying drawings, and it will be apparent to those skilled in the art that various substitutions, modifications, and changes are possible without departing from the technical spirit of the embodiment.

What is claimed is:

1. A chair with a forehead rest, comprising:

a seating part (10) which includes a seat board (11) and a support leg (12) supporting the seat board (11) and on which the user (1) is seated;

a main support arm (20) which extends vertically and is rotatably coupled to one side of the seating part (10) by a hinge shaft (23) formed horizontally;

an elastic support arm (30) which is provided on an upper end of the main support arm (20) and includes a first elastic support arm part (31) that bends forward while protruding upward and a second elastic support arm part (32) protruding downward from a leading end of the first elastic support arm part (31) to be bent rearward toward a lower end of the second elastic support arm part (32); and a forehead rest (40) which is provided on a leading end of the second elastic support arm part (32) of the elastic support arm (30) and by which a forehead (2) of a user (1) is supported, wherein the user (1) seated on the seating part (10) is allowed to move a head forward, rearward, leftward, and rightward in a state in which the forehead (2) is pressed against the forehead rest (40).

2. The chair with the forehead rest of claim 1, further comprising an elastic member (50) having both end portions fixed to a lower end of the main support arm (20) and a lower end portion of the support leg (12) of the seating part (10), wherein the main support arm (20), which rotates about the hinge shaft (23), is returned to an original state by the elastic member (50).

3. The chair with the forehead rest of claim 1, wherein the forehead rest (40) includes:

a rest body (41) of which both end portions protrude forward and a central portion of a rear surface is rotatably coupled to a leading end of an elastic support arm (30) by a spherical hinge (33);

a pair of rest heads (44, 45) of which central portions of rear surfaces are rotatably coupled to the both end portions of the rest body (41) and in which curved surfaces are formed on front surfaces of the pair of rest heads (44, 45) to be pressed against the forehead (2) of the user (1); and buffer springs (49) which are provided at coupling portions of the rest heads (44, 45) and the rest body (41) and buffer the rest heads (44, 45).

4. The chair with the forehead rest of claim 2, wherein the forehead rest (40) includes:

a rest body (41) of which both end portions protrude forward and a central portion of a rear surface is rotatably coupled to a leading end of an elastic support arm (30) by a spherical hinge (33);

a pair of rest heads (44, 45) of which central portions of rear surfaces are rotatably coupled to the both end portions of the rest body (41) and in which curved surfaces are formed on front surfaces of the pair of rest heads (44, 45) to be pressed against the forehead (2) of the user (1); and buffer springs (49) which are provided at coupling portions of the rest heads (44, 45) and the rest body (41) and buffer the rest heads (44, 45).

* * * * *